US005152035A

United States Patent [19]

Morita

[11] Patent Number: 5,152,035

[45] Date of Patent: Oct. 6, 1992

[54] MAGNETIC FASTENER

[75] Inventor: Tamao Morita, Tokyo, Japan

[73] Assignee: Tarmo Co., Ltd., Tokyo, Japan

[21] Appl. No.: 790,989

[22] Filed: Nov. 13, 1991

[30] Foreign Application Priority Data

Dec. 28, 1990 [JP] Japan ..... 2-415414

[51] Int. Cl.[5] ..... A44B 21/00; H01F 7/00

[52] U.S. Cl. ..... 24/303; 292/251.5

[58] Field of Search ..... 24/303, 688, 94, 49 M; 292/251.5; 335/285

[56] References Cited

U.S. PATENT DOCUMENTS

| | | | |
|---|---|---|---|
| 3,324,521 | 6/1967 | Humiston | 24/303 |
| 4,265,002 | 5/1981 | Hosken | 24/303 |
| 4,941,235 | 7/1990 | Aoki | 292/251.5 |
| 4,991,270 | 2/1991 | Aoki | 292/251.5 |

FOREIGN PATENT DOCUMENTS

| | | | |
|---|---|---|---|
| 0018614 | 1/1984 | Japan | 335/285 |
| 0115807 | 5/1987 | Japan | 335/285 |

*Primary Examiner*—Victor N. Sakran

*Attorney, Agent, or Firm*—Pennie & Edmonds

[57] ABSTRACT

A magnetic fastener utilizes the attraction force of a permanent magnet which comprises an attraction member comprising a permanent magnet having a through-hole extending between the magnetic poles and a ferromagnetic member attached on one of the magnetic poles of the permanent magnet, and a attracted member to be attracted to the ferromagnetic member via the through-hole of the permenant magnet. The angle formed by the magnetic pole surface to which the attracted member is attracted and the peripheral side face extending between the magnetic pole surfaces of the permanent magnetic is 95° or larger.

16 Claims, 8 Drawing Sheets

MAGNETIC FASTENER

CROSS REFERENCE TO RELATED APPLICATION

Figure 1:
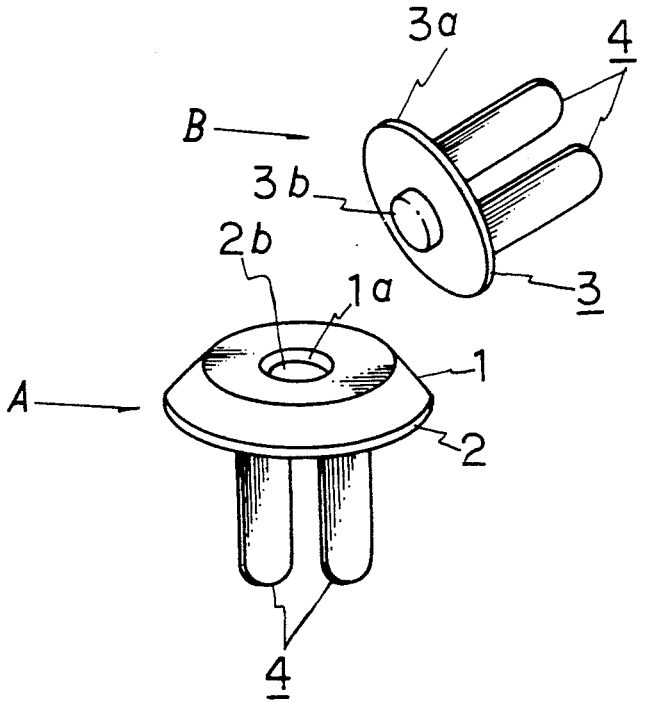

This invention is related to copending application Ser. No. 07/790,990, filed Nov. 13, 1991.

SUMMARY OF THE INVENTION

The present invention relates to a fastener means which effectively utilizes the attraction force of a permanent magnet. More in particular, the invention offers a fastener means which effectively utilizes the attraction force of the permanent magnet by minimizing the leakage flux as much as possible.

According to the present invention, the fastener means includes an attraction means which comprises a permanent magnet with a through-hole extending between the magnetic poles and a ferromagnetic member attached on one of the magnetic pole surfaces of the permanent magnet, and a means to be attracted by abutment to the ferromagnetic member of the attraction means via the through-hole of the permanent magnet, the fastener means being characterized in that the angle formed by the magnetic pole surface to which said attracted means is attracted and the peripheral side face extending between the magnetic pole surfaces of the permanent magnet is 95° or larger.

BACKGROUND OF THE INVENTION

A variety of fastener means utilizing the attraction of a permanent magnet has been known, and each differs in the structure depending on the use.

As one typical example of a fastener means for handbags, etc., there is known a magnetic lock closure for baggages and satchels disclosed in the Japanese Utility Model Publication No. Sho 56-45985.

This prior art lock closure uses a disk-like permanent magnet having a through-hole in the direction of the magnetic poles. The permanent magnet is housed in a plate-like casing. An attracting member is formed by placing a ferromagnetic plate having a ferromagnetic projection within said casing, with the ferromagnetic projection extending in said through-hole and the ferromagnetic plate being in contact with the plane of a magnetic pole of said permanent magnet. A member to be attracted within the through-hole of the permanent magnet constituting the attraction member comprises a ferro-magnetic projection which abuts against and is attracted by the projection of the attraction member and a ferromagnetic plate which is attracted to the surface of the attraction member.

One of the magnetic poles of the permanent magnet of the attraction member is attached with a ferromagnetic plate, while the other magnetic pole attracts a ferro-magnetic plate that constitutes the attracted member in the prior art lock closure. The magnetic force converged on the ferromagnetic plates of the attraction and attracted members forms a closed circuit as it passes the respective ferromagnetic projections located inside the through-hole. The lock closure of this construction features a higher efficiency of attraction as compared with the fastening means of other constructions utilizing a permanent magnet. However, the permanent magnet of the attraction member is formed like a disk in the prior art lock closure, and its surfaces at the magnetic poles and its peripheral side face between the poles form substantially a right angle. As a result, the magnetic poles of the permanent magnet are arranged at the shortest interval distance for its thickness.

It is generally known that the magnetic flux of a permanent magnet connects the two magnetic poles with a circuit with the least reluctance. When ferromagnetic projections are interposed between the two surfaces of the magnetic poles, as is the case of said lock closure, much of the magnetic flux becomes converged on the projections.

However, it is also generally known that when a permanent magnet is arranged at a position away from said projections as in the prior art lock closure, the magnetic flux along the peripheral edge of the respective magnetic pole surface forms a magnetic path along the peripheral side of the magnet between the magnetic poles as a path with a magnetic reluctance lower than that of the path leading to the projections.

The prior art lock closure is defective in that the magnetic flux on the peripheral side of the permanent magnet does not contribute to the attraction force of the lock closure; rather, it tends to destroy the information magnetically recorded on magnetic tickets, etc.

Because the permanent magnet used in the lock closure has the minimum distance between the magnetic poles for its thickness, considerable leakage flux occurs on the peripheral side, weakening the attraction force of the lock closure by the amount of this leakage flux.

OBJECTS OF THE INVENTION

The present invention aims at improvement of such prior art fastener means which utilizes the attracting force of a permanent magnet, minimizes the leakage flux on the peripheral side of the permanent magnet, prevents destruction of the information recorded on magnetic medium such as the bank cashing cards and credit cards. The invention also aims at protecting magnetic data stored on a subway ticket. When the attraction means contacts tapes and hard discs on which data and information are stored magnetically, such data and information are protected against destruction. Similarly data and information magnetically stored in various goods are also protected against destruction as the attracting means contact them.

Another primary objective of the present invention is to minimize the leakage flux occurring between the magnetic poles on the periphery side of the permanent magnet which comprises the attraction means as much as possible and to effectively utilize the attraction force of the permanent magnet used. By separating the magnetic poles on the periphery side of the magnet, the leakage flux occurring around the periphery of the magnet is minimized, and the flux is gathered concentrated to the ferromagnetic member that passes through the through-hole at the center of the magnet, to thereby improve the attraction at the portion where the ferromagnetic member contacts.

Further objects of the present invention will become clear from the detailed description of the present invention and the patent claims thereof.

Figure 2:
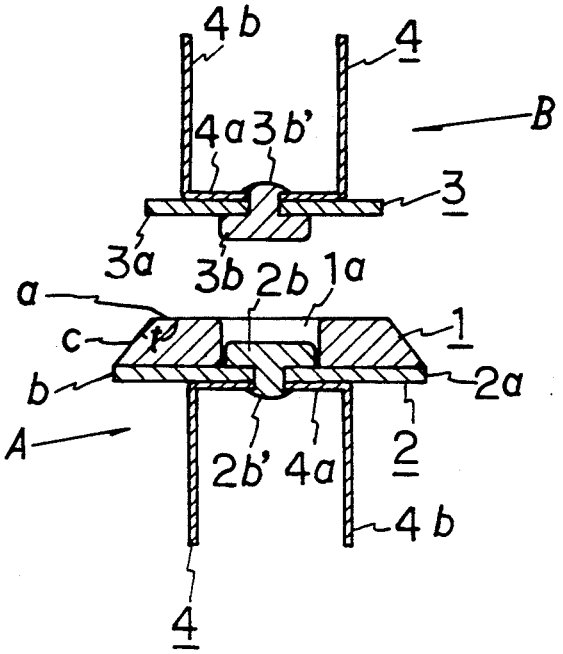
Figure 3:
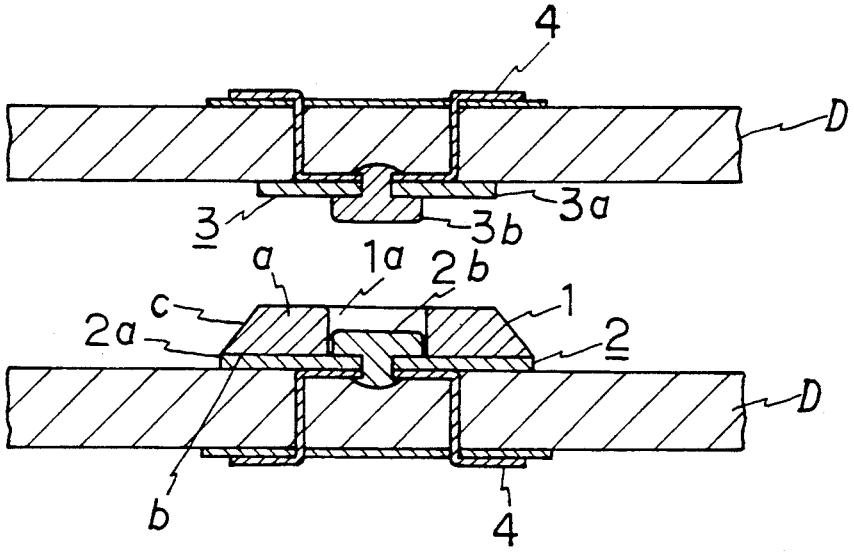
Figure 4:
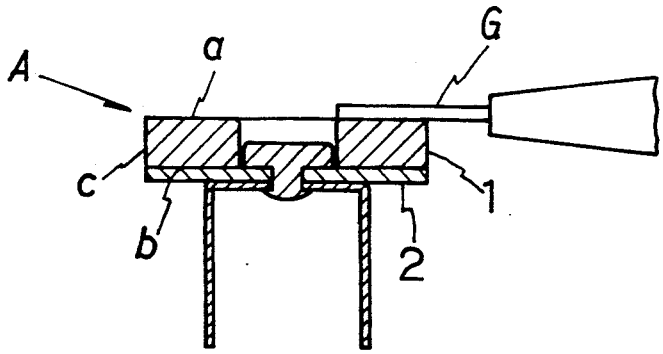
Figure 5:
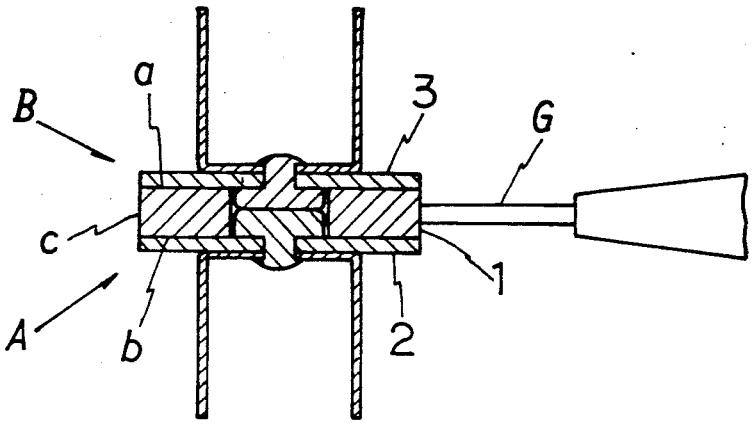
Figure 9:
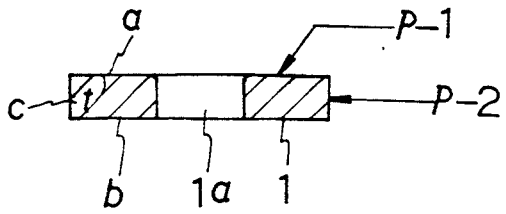
Figure 12:
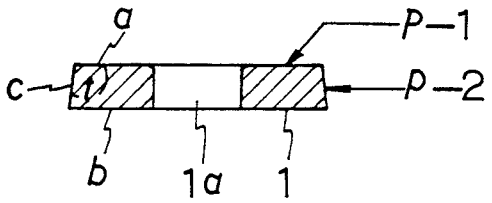
Figure 10:
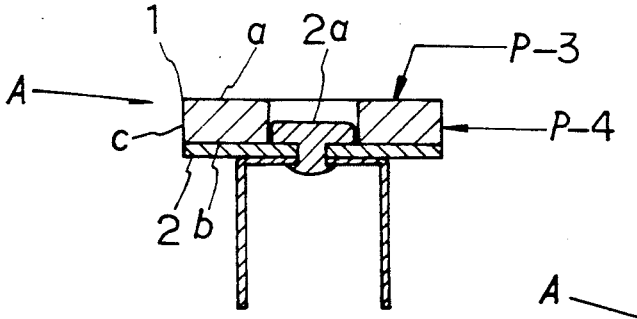
Figure 13:
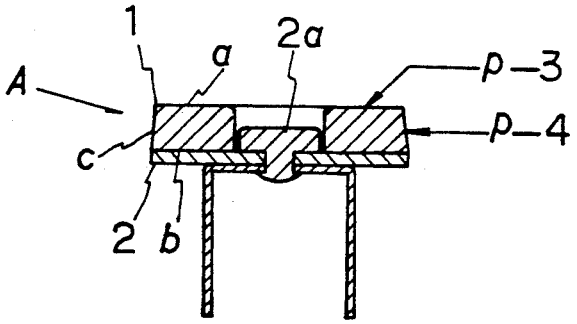
Figure 11:
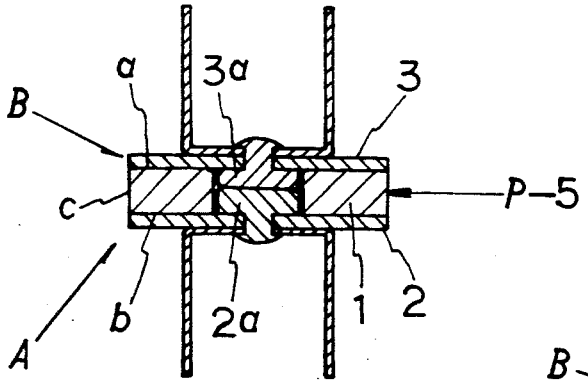
Figure 14:
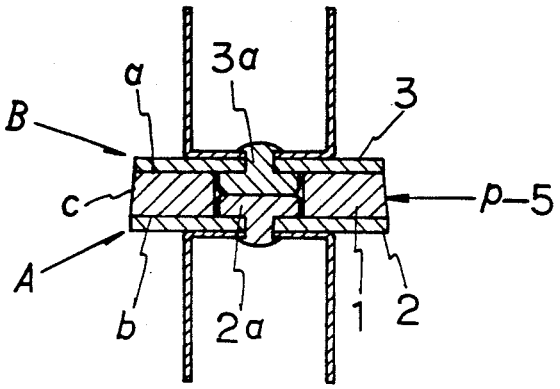
Figure 15:
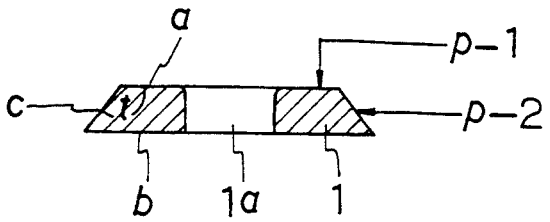
Figure 18:
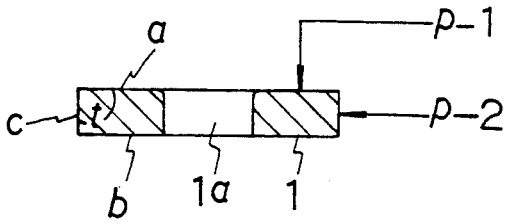
Figure 16:
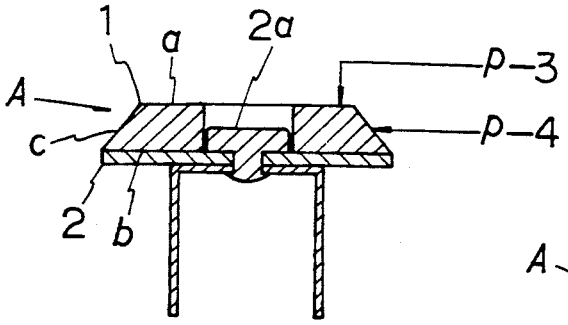
Figure 19:
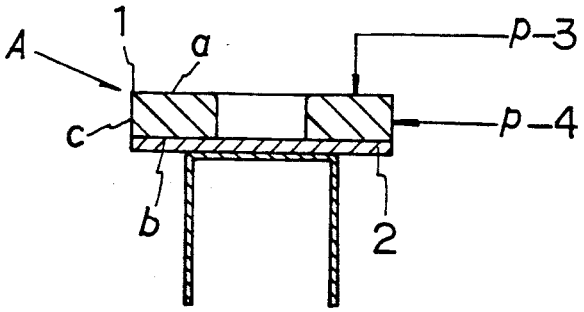
Figure 17:
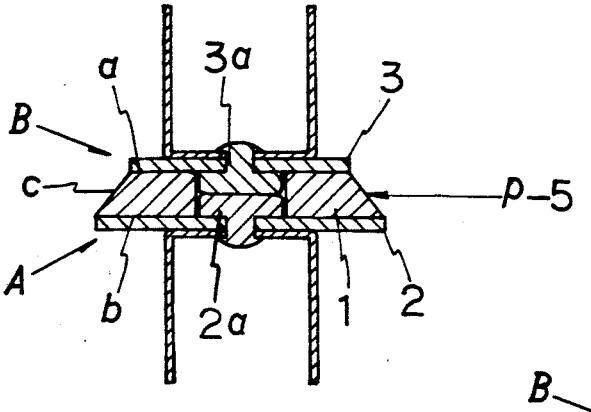
Figure 20:
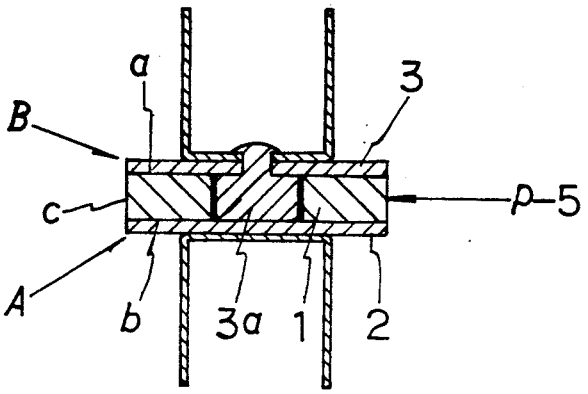
Figure 21:
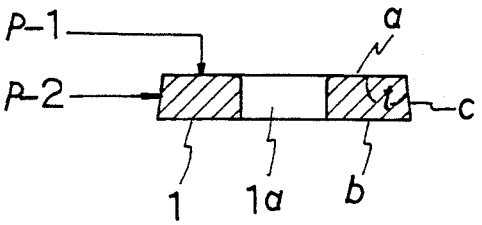
Figure 24:
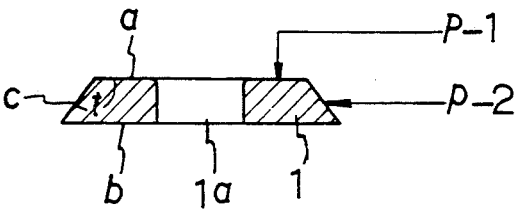
Figure 22:
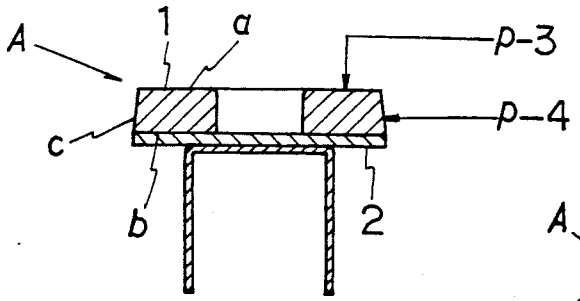
Figure 25:
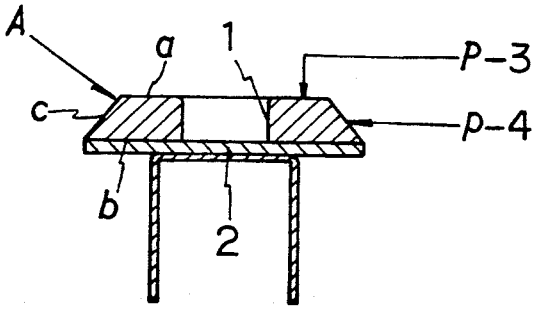
Figure 23:
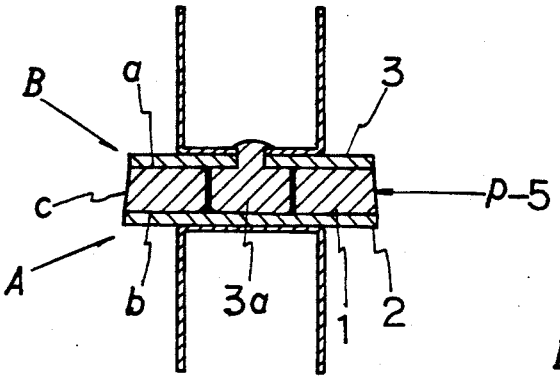
Figure 26:
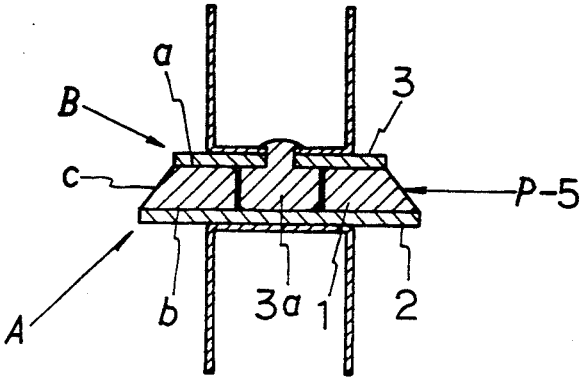
Figure 27:
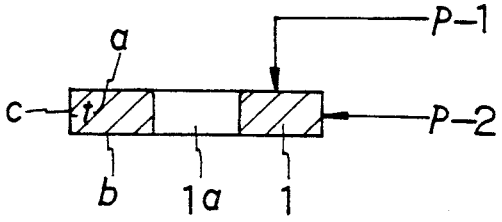
Figure 30:
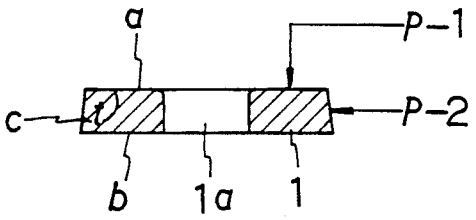
Figure 28:
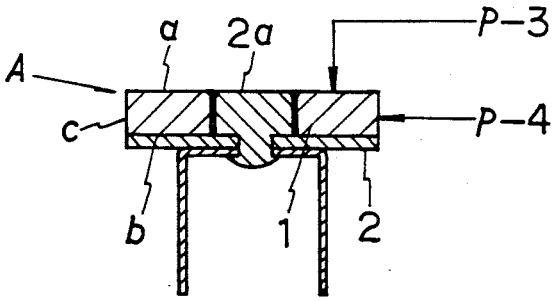
Figure 31:
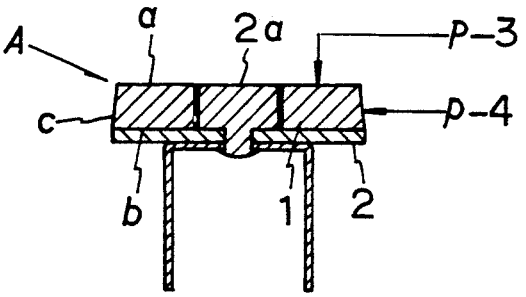
Figure 29:
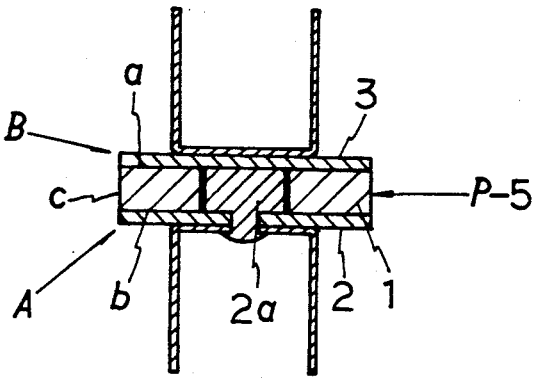
Figure 32:
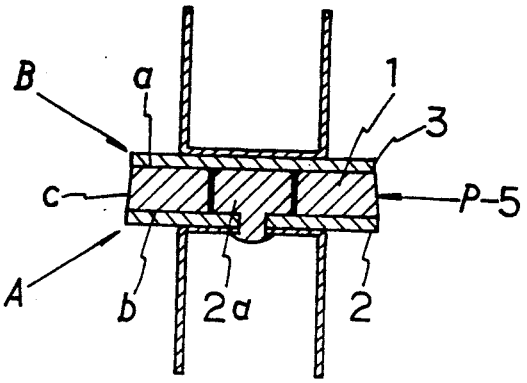
Figure 33:
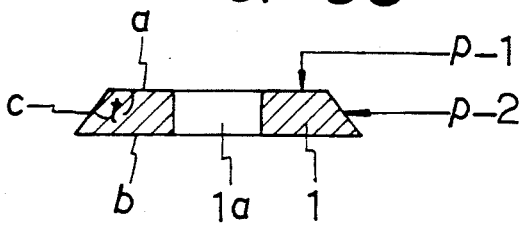
Figure 34:
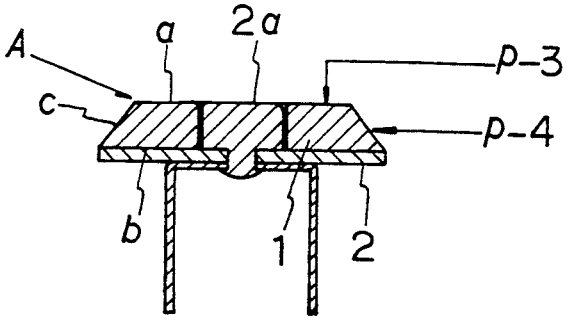
Figure 35:
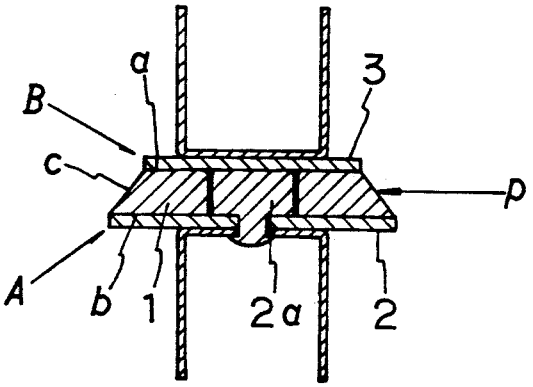
Figure 36:
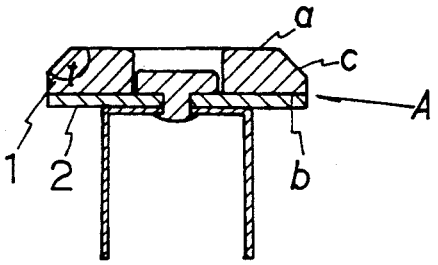
Figure 37:
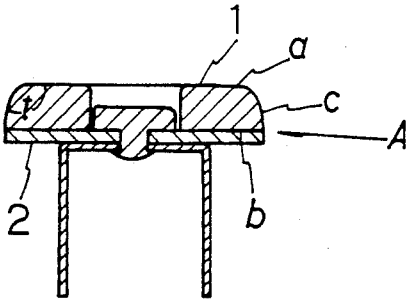
Figure 38:
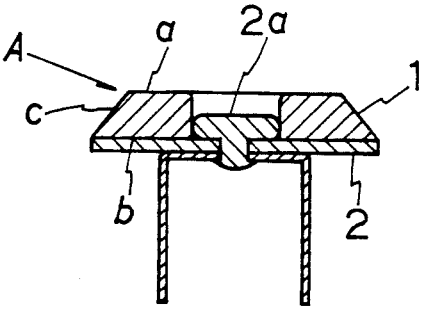
Figure 39:
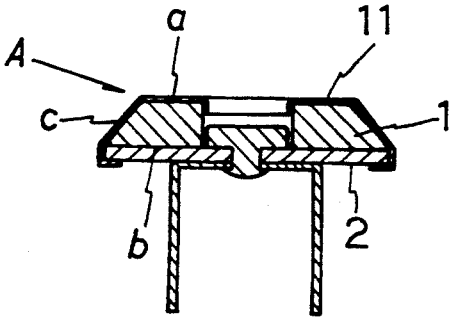
Figure 40:
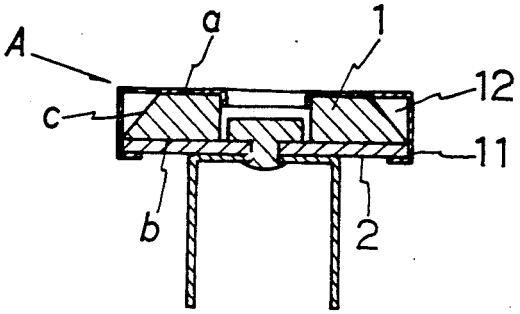
Figure 6:
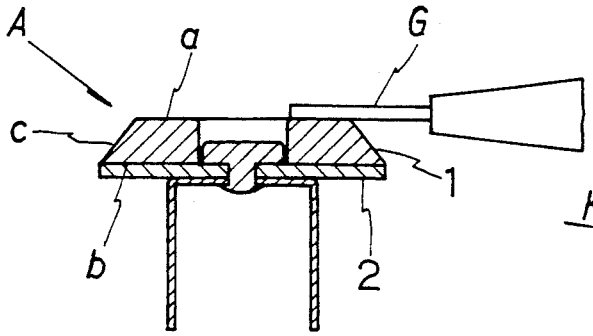
Figure 8:
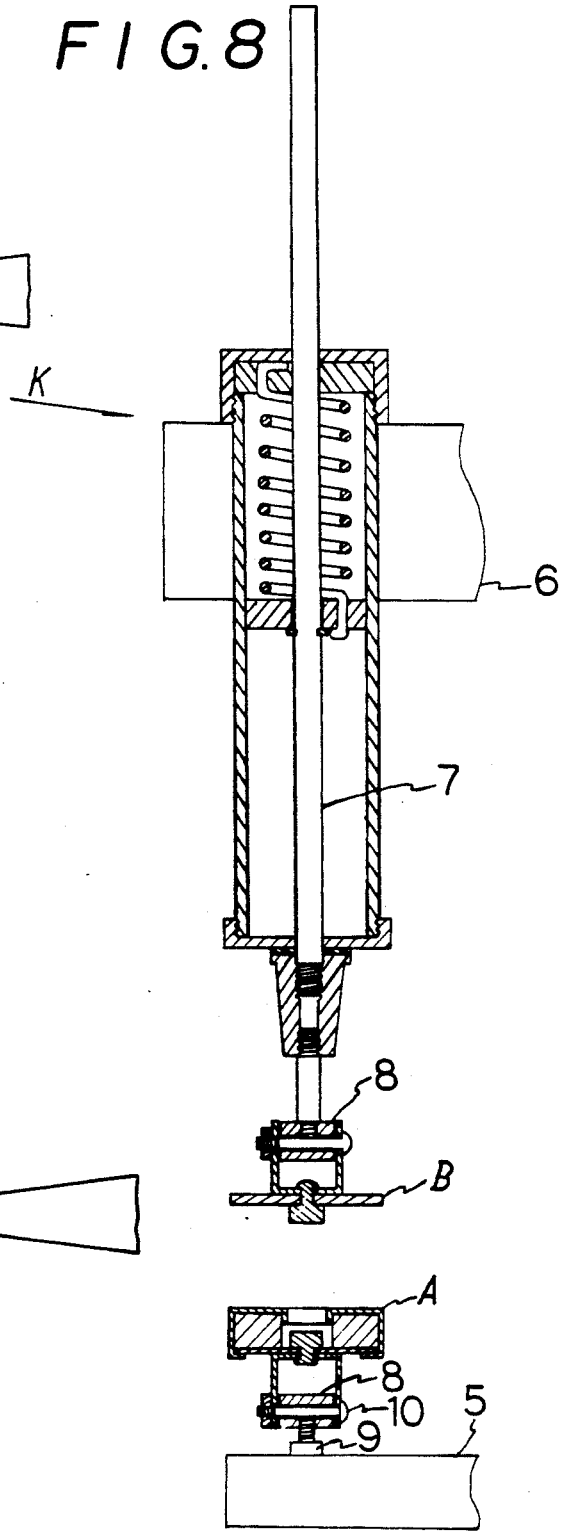
Figure 7:
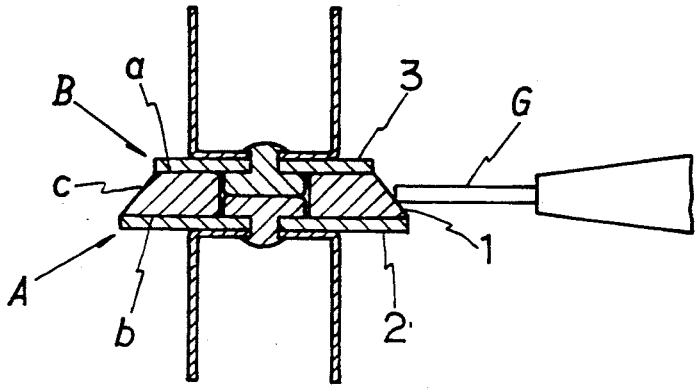

FIGS. 1 to 3 show ar. embodiment of a fastener according to the present invention. FIG. 1 is a perspective view to show the fastener means as they are separated. FIG. 2 is a sectional view of the fastener means. FIG. 3 is a sectional view to show the attachment of the fastener means. FIGS. 4 and 5 show how the magnetic flux of the attraction means of a Comparative Embodiment is measured. FIGS. 6 and 7 show how the magnetic flux of the Embodiment attraction means is measured. FIG. 8 is a sectional view to show how the magnetic flux of the Embodiment attraction means is measured. FIGS. 9 through 11 the Comparative Embodiment 1. FIG. 9 is a sectional view of the permanent magnet used in the Comparative Embodiment 1. FIG. 10 is a sectional view of the attraction means of the Comparative Embodiment 1. FIG. 11 is a sectional view of the fastener means of the Comparative Embodiment 1. FIG. 12 a sectional view of the permanent magnet used in the Embodiment 1. FIG. 13 is a sectional view of the attraction means of the Embodiment 1. FIG. 14 is a sectional view of the fastener means of the Embodiment 1.FIGS. 15 through 17 show the Embodiment 2. FIG. 15 is a sectional view of the permanent magnet used in the Embodiment 2. FIG. 16 is a sectional view of the attraction means of the Embodiment 2. FIG. 17 is a sectional view of the fastener means of the Embodiment 2. FIG. 18 through 20 show the Comparative Embodiment 2. FIG. 18 is a sectional view of the permanent magnet used in the Comparative Embodiment 2. FIG. 19 is a sectional view of the attraction means used in the Comparative Embodiment 2. FIG. 20 is a sectional view of the fastener means of the Comparative Embodiment 2. FIGS. 21 through 23 show the Embodiment 3. FIG. 21 is a sectional view of the permanent magnet used in the Embodiment 3. FIG. 22 is a sectional view of the attraction means of the Embodiment 3. FIG. 23 is a sectional view of the means of the Embodiment 3. FIGS. 24 through 26 show the Embodiment 4. FIG. 24 is a sectional view of the permanent magnet used in the Embodiment 4. FIG. 25 is a sectional view of the attraction means of the Embodiment 4. FIG. 26 is a sectional view of the fastener means of the Embodiment 4. FIGS. 27 through 29 show the Comparative Embodiment 3. FIG. 27 is a sectional view of the permanent magnet used in the Comparative Embodiment 3. FIG. 28 is a sectional view of the attraction means of the Comparative Embodiment 3. FIG. 29 is a sectional view of the fastener means of the Comparative Embodiment 3. FIGS. 30 through 32 show the Embodiment 5. FIG. 30 is a sectional view of the permanent magnet used in the Embodiment 5. FIG. 31 is a sectional view of the attraction means of the Embodiment 5. FIG. 32 is a sectional view of the fastener means of the Embodiment 5. FIGS. 32 through 35 show the Embodiment 6. FIG. 33 is a sectional view of the permanent magnet used in the Embodiment 6. FIG. 34 is a sectional view of the attraction means of the Embodiment 6. FIG. 35 is a sectional view of the fastener means of the Embodiment 6. FIG. 36 is a sectional view to show another embodiment of the attraction means. FIG. 37 is a sectional view to show still another embodiment of the attraction means. FIG. 38 is a sectional view to show still another embodiment of the attraction means. FIG. 39 is sectional view to show still another embodiment of the attraction means. FIG. 40 is a sectional view to show still another embodiment of the attraction means.

EMBODIMENTS

Embodiments of the fastener means according to the present invention will now be described referring to the attached drawings.

FIGS. 1 through 3 show a typical embodiment according to the present invention: FIG. 1 is a perspective view to show the attraction means A and the attracted means B; FIG. 2 is a sectional view thereof; and FIG. 3 is a sectional view to show how these means are attached.

The attraction means A which constitutes the fastener means comprises a disk-like permanent magnet 1 having a through-hole la that extends in the direction of the magnetic poles, and a ferromagnetic member 2 attached on one magnetic pole surface b of the magnet 1. The attracted means B comprises a ferromagnetic member 3 which is to be attracted not only to the other magnetic pole surface a where the ferromagnetic member 2 of the means A is not attached but to said ferromagnetic member 2 via the through-hole 1*a*.

In this embodiment, the ferromagnetic member 2 includes a ferromagnetic plate 2*a* and a ferromagnetic projection 2*b* while the ferromagnetic member 3 includes a ferromagnetic plate 3*a* and a ferromagnetic projection 3*b*.

Both the attraction means A and the attracted means B are provided with legs 4 having strips 4*b*, 4*b* to allow the members to be attached on the base material D of a handbag, etc. With a base 4*a* of the leg 4 being attached to the ferromagnetic plate 2*a* of the ferromagnetic member 2, the portion 2*b*' of the projection 2*b* with a smaller diameter in the through-hole 1*a* of the magnet is thrusted in the plate 2*a* and the base 4*a* and integrally caulked and attached to the permanent magnet 1.

The base 4*a* of the leg 4 is attached to the ferromagnetic plate 3*a* of the ferromagnetic member 3. The portion 3*b*' of the projection 3*b* with the smaller diameter erected from the ferromagnetic plate 3*a* is thrusted in the plate 3*a* and the base 4*a* and caulked to integrally form the attracted means B.

In the fastener means of the above construction, the magnetic pole surface a of the magnet 1 of the attraction means A and the peripheral side face c extending between the magnetic poles form an angle t which is 95° or greater.

Although the permanent magnet 1 in this embodiment is not covered with a casing, it is possible to integrally contain the permanent magnet 1 and the ferromagnetic member 2 in a casing to form the attraction means.

The magnet 1 and the ferromagnetic member 2 may be bonded with an adhesive; alternatively, the magnet 1 and the ferromagnetic member 2 may be formed integral by insert molding using plastics.

The permanent magnet may be in the form of a disk, a rectangle, or an ellipse.

As will be described later, the ferromagnetic projections 2*b* and 3*b* provided on the ferromagnetic members 2 and 3 respectively may be such that the ferromagnetic members 2 and 3 will be abutted against and attracted to each other in the through-hole 1*a* of the magnet 1 of the attraction means A. Either one of them may be omitted, and the height of the projections 2*b* and 3*b* may either be identical or different.

Further, instead of providing the ferromagnetic projections 2*b* and 3*b* separately from the ferromagnetic plates 2*a* and 3*a* respectively, they may be formed as an integral projection from the plates 2*a* and 3*a* respectively by press molding and the like.

As the peripheral side face c of the fastener means having the above construction is wider than the prior art fastener means wherein the angle t formed by the magnetic pole surface a of the magnet 1 and the peripheral side face c is 90°, the magnetic pole surfaces will be separated by a greater distance.

As a result, the magnetic flux on the magnetic pole surface b can be easily contained in the circuit formed by the ferromagnetic plate 2*a*, the ferromagnetic projections 2*b*, 3*b*, ferromagnetic plate 3*a* and the magnetic pole surface a, enhancing the magnetic attraction between the projections 2*b* and 3*b* and reducing the flux leakage from the peripheral side face c.

Changes int eh magnetic flux distribution attributable to the geometric characteristics of the permanent magnet 1 will now be described based on the actual measurements.

First, reference is made to a fastener means wherein the ferromagnetic members 2 and 3 are both provided with projections 2*b* and 3*b* respectively.

The intensity of magnetic flux was measured using a gaussmeter. As shown in FIGS. 4 through 7, the sensor G of the gaussmeter was attached to the magnetic pole surface a of the permanent magnet 1 when the attraction means A was measured separately. When the means B was attracted to the attraction means A, the sensor G of the gaussmeter was abutted against the peripheral side face c of the magnet 1 in such a manner that the sensor G would be placed in parallel with the magnetic pole surface a of the magnet 1.

FIGS. 4 and 5 show how the prior art lock closure is measured by a gaussmeter, and FIGS. 6 and 7 show the method of measuring the present invention fastener means.

In the measurements, the galvanomagnetic effect type gaussmeter Model GT-3B (Nippon Denji Sokutei K.K.) with a gallium arsenide sensor was used.

The attraction force of the fastener means was measured using the system shown in FIG. 8. As shown in the figure, the attraction means A was attached to the support 5 of the instrument K while the attracted means B was attached to the tip of the tension rod 7 provided on the movable arm 6 of the instrument K. The movable arm 6 was pulled up, and the pulling strength (kg) when the attracted means B was detached from the attraction means A was measured.

The instrument K is manufactured by Oba Keiki Seisakusho as the standard cylinder type tension gage. A sleeve 8 was interposed between the leg strips 4*b*, 4*b* of the means A and B. The sleeve 8 was in turn engaged with a screw rod 9 of the fixing screw. The leg strips 4*b*, 4*b* were provided with a bore each, through which a pin 10 was inserted into the sleeve 8 to assemble the means A and B for the measurement.

Comparative Embodiment 1

The fastener means shown in FIGS. 9 through 11 uses a permanent magnet 1 of the attraction means A wherein the angle formed by the magnetic pole surface a and the peripheral side face c is 90°, the diameter of both the magnetic pole surfaces a and b is 19.1 mm, the diameter of the through-hole 1*a* is 6.2 mm, the plate thickness is 3.2 mm, and the weight is 2.8 g.

As shown in Table 2, the intensity of the magnetic flux of the magnet 1 of the Comparative Embodiment 1 was 556 Gauss at P-1 and 308 Gauss at P-2. When the ferromagnetic member 2 was attached, the measurement read 612 Gauss at P-3 and 315 Gauss at P-4, indicating an increase in the leakage flux due to attachment of the ferromagnetic member 2. Measurement at P-5 when the attracted member B was attached was extremely low in the leakage flux or 122 Gauss.

The attraction force of the Comparative Embodiment 1 was averaged at 2.28 kg under the condition as shown in FIG. 11. The result of measurement is shown in Table 1.

Embodiment 1

The fastener means shown in FIGS. 12 through 14 comprises the attraction means A and attracted means B, each having a ferromagnetic projection 2*b*, 3*b* respectively. The angle t formed between the magnetic pole surface a and the peripheral side face c of the magnet 1 in the attraction means A is 95°. The diameter of the magnetic pole surface a is 18.7 mm, that of the surface b is 19.2 mm, the plate thickness is 3.2 mm, the diameter of the through-hole la is 6.2 mm, and the weight is 2.8 g.

Measurements of the leakage flux at P-1, P-2, P-3, P-4 and P-5 of the magnet 1 of the Embodiment 1 alone, of the magnet 1 attached with the ferromagnetic member 2, and of the magnet 1 attached with both the attraction and attracted means A and B are shown respectively in Table 2.

The attraction force of the fastener means according to the Embodiment 1 was measured under the condition as shown in FIG. 14. As shown in Table 1, the average attraction force was 2.55 kg.

Embodiment 2

The fastener means shown in FIGS. 15 through 17 comprises the attraction means A and attracted means B, each having the ferromagnetic projection 2*b* and 3*b* respectively. The angle t between the magnetic pole surface a and the peripheral side face c is 130°. The diameter of the surface a is 16 mm, that of the surface b is 21 mm, the plate thickness is 3.2 mm, the diameter of the through-hole la is 6.2 mm, and the weight is 2.8 g.

Measurements of the leakage flux at P-1, P-2, P-3, P-4 and P-5 of the magnet 1 of the Embodiment 2 alone, of the magnet 1 attached with the ferromagnetic member 2, and of the magnet 1 attached with both the attraction and attracted means A and B respectively are shown in Table 2.

The attraction force of the fastener means according to the Embodiment 2 was measured under the condition as shown in FIG. 17. As shown in Table 1, the average attraction force was 2.65 kg.

TABLE 1

| | Attraction Force (kg) | | |
|---|---|---|---|
| Measurement | Comparative 1 Embodiment | Embodiment 1 | Embodiment 2 |
| I | 2.30 | 2.60 | 2.70 |
| II | 2.25 | 2.45 | 2.55 |
| III | 2.25 | 2.55 | 2.65 |
| IV | 2.30 | 2.65 | 2.55 |
| V | 2.30 | 2.50 | 2.70 |
| Average | 2.28 | 2.55 | 2.65 |

TABLE 2

| | Intensity of Magnetic Flux (Gauss) | | |
|---|---|---|---|
| Measurement point | Comparative 1 Embodiment | Embodiment 1 | Embodiment 2 |
| P-1 | 556 | 566 | 581 |
| P-2 | 308 | 295 | 281 |
| P-3 | 612 | 630 | 654 |
| P-4 | 315 | 306 | 280 |
| P-5 | 122 | 110 | 89 |

The permanent magnets 1 used in the embodiments 1 and 2 and the Comparative Embodiment 1 all weigh 2.8 g, and are magnetized under the same conditions.

As is evident from the Table, the attraction force of the Embodiment 1 shows an increase by 11.8% and the Embodiment 2 an increase by 16.2% as compared with the Comparative Embodiment 1.

The values of leakage flux on the magnetic pole surface a of the magnet 1 of the Embodiments 1 and 2 at P-1 and P-3 respectively are greater than those of the Comparative Embodiment 1, indicating that an excellent magnetic field suitable for attracting the means B is formed.

The values of leakage flux on the peripheral side face c of the magnet 1 at P-2, P-4 and P-5 in the Embodiments 1 and 2 respectively are smaller than those of the Comparative Embodiment 1, indicating that a magnetic field is suitably formed in the Embodiments to avoid destruction of information magnetically recorded on a magnetic ticket and the like which might otherwise be caused by the leakage flux from the peripheral side face c.

The angle t between the magnetic pole surface a and the peripheral side face c of the magnet 1 can be designed still larger. However, if the angle t is made too large, the angle between the magnetic pole surface b and the peripheral side face c becomes too small, making the edge of the magnet 1 between faces b and c too brittle. Even if the magnetic pole surface b is designed sufficiently large in area and the angle t is designed extremely large, the surface a on which the means B is to be attracted to its counterpart becomes relatively too small for use, nor is it preferable in terms of appearance.

In view of the foregoing, the angle t between the magnetic pole surface a and the peripheral side face c of the magnet 1 is designed preferably to be 145° or smaller.

Comparative Embodiment 2

The attracted means B of the fastener means of the Comparative Embodiment 2 shown in FIGS. 18 through 20 is provided with the ferromagnetic projection 3*b*, which is directly contacted with the ferromagnetic plate 2*a* of the attraction means A within the through-hole 1*a*. The ferromagnetic member 2 is not provided with the projection 2*b*. The angle t between the magnetic pole surface a and the peripheral side face c of the magnet 1 in the attraction means A is 90°, the diameter of both the magnetic pole surfaces a and b is 19.1 mm, the plate thickness is 3.2 mm, the diameter of the through-hole 1*a* is 6.2 mm and the weight is 2.8 g.

Table 4 shows the measurements of magnetic flux at P-1, P-2, P-3, P-4 and P-5 of the magnet 1 of the Comparative Embodiment 2 alone, of the magnet 1 attached with the ferromagnetic member 2 and when the attraction and attracted means A and B are assembled.

The attraction force of the fastener means according to the Comparative Embodiment 2 was measured under the condition as shown in FIG. 20. As shown in Table 3, the average attraction force was 2.28 kg.

Embodiment 3

The fastener means of Embodiment 3 shown in FIGS. 21 through 23 comprises the attracted means B having the ferromagnetic projection e*b*, which is directly contacted with the ferromagnetic plate 2*a* of the attraction means A within the through-hole 1*a*. The ferromagnetic member 2 is not provided with the projection 2*b*. The angle t between the magnetic pole surface a and the peripheral side face c is 95°. The diameter of the surface a is 18.7 mm, that of the surface b is 19.2 mm, the plate thickness is 3.2 mm, the diameter of the through-hole 1*a* is 6.2 mm, and the weight is 2.8 g.

Measurements of the leakage flux at P-1, P-2, P-3, P-4 and P-5 of the magnet 1 alone, of the magnet 1 attached with the ferromagnetic member 2 and of the magnet 1 attached with both the attraction and attracted means A and B respectively are shown in Table 4.

The attraction force of the fastener means according to the Embodiment 3 was measured under the condition as shown in FIG. 23. As shown in Table 3, the average attraction force was 2.52 kg.

Embodiment 4

The fastener means of the Embodiment 4 shown in FIGS. 24 through 26 comprises the attracted means B having the ferromagnetic projection 3*b*, which is directly contacted with the ferromagnetic plate 2*a* of the attraction means A within the through-hole 1*a*. The ferromagnetic member 2 is not provided with the projection 2*b*.

The angle t between the magnetic pole surface a and the peripheral side face c is 130°. The diameter of the surface a is 16 mm, that of the surface b is 21 mm, the plate thickness is 3.2 mm, the diameter of the through-hole 1*a* is 6.2 mm, and the weight is 2.8 g.

Measurements of the leakage flux at P-1, P-2, P-3, P-4 and P-5 of the magnet 1 alone, of the magnet 1 attached with the ferromagnetic member 2 and of the magnet 1 attached with both the attraction and attracted means A and B respectively are shown in Table 4.

The attraction force of the fastener means according to Embodiment 4 was measured under the condition as shown in FIG. 26. As shown in Table 3, the average attraction force was 2.57 kg.

TABLE 3

| | Attraction Force (kg) | | |
|---|---|---|---|
| Measurement | Comparative 2 Embodiment | Embodiment 3 | Embodiment 4 |
| I | 2.30 | 2.45 | 2.55 |
| II | 2.30 | 2.55 | 2.60 |
| III | 2.30 | 2.50 | 2.55 |
| IV | 2.20 | 2.55 | 2.55 |
| V | 2.30 | 2.55 | 2.60 |
| Average | 2.28 | 2.52 | 2.57 |

TABLE 4

| | Intensity of Magnetic Flux (Gauss) | | |
|---|---|---|---|
| Measurement point | Comparative 2 Embodiment | Embodiment 3 | Embodiment 4 |
| P-1 | 556 | 566 | 581 |
| P-2 | 308 | 295 | 281 |
| P-3 | 613 | 624 | 645 |
| P-4 | 320 | 312 | 285 |
| P-5 | 119 | 111 | 99 |

The permanent magnets 1 used in the Comparative Embodiment 2 and the Embodiments 3 and 4 all weigh 2.8 g, and are magnetized under the same conditions.

It is evident that the attraction force of the Embodiment 3 shows an increase by 10.5% and the Embodiment 4 an increase by 12.7% as compared with the Comparative Embodiment 2.

The values of leakage flux on the magnetic pole surface a of the magnet 1 in the Embodiments 3 and 4 at P-1 and P-3 respectively are greater than those of the Comparative Embodiment 2, indicating that an excellent magnetic field suitable for attracting the means B is formed.

The values of leakage flux on the peripheral side face c of the magnet 1 at P-2, P-4 and P-5 in the Embodiments 3 and 4 respectively are smaller than those of the Comparative Embodiment 2, indicating that a magnetic field is suitably formed in the Embodiments to avoid destruction of information magnetically recorded on a magnetic ticket and the like which might otherwise be caused by the leakage flux from the peripheral side face c.

Comparative Embodiment 3

The attracted means B of the fastener means shown in FIGS. 27 through 29 has no ferromagnetic projection 3*b*; instead, the ferromagnetic projection 2*b* projecting inside the through-hole la of the magnet 1 is directly contacted with the ferromagnetic plate 3*a* of the attracted means B.

The angle t between the magnetic pole surface a and the peripheral side face c of the magnet 1 in the attraction means A is 90°, the diameter of both the magnetic pole surfaces a and b is 19.1 mm, the plate thickness is 3.2 mm, the diameter of the through-hole 1*a* is 6.2 mm and the weight is 2.8 g.

Table 6 shows the measurements of magnetic flux at P-1, P-2, P-3, P-4 and P-5 of the magnet 1 of the Comparative Embodiment 3 alone, of the magnet 1 attached with the ferromagnetic member 2 and when the attraction and attracted means A and B are assembled.

The attraction force of the fastener means according to the Comparative Embodiment 3 was measured under the condition as shown in FIG. 29. As shown in Table 5, the average attraction force was 2.25 kg.

Embodiment 5

The attracted member B of the fastener means according to the Embodiment 5 shown in FIGS. 30 through 32 is not provided with the ferromagnetic projection 3*b*; instead, the ferromagnetic projection 2*b* projecting within the through-hole 1*a* is directly contacted with the ferromagnetic plate 3*a* of the attracted means B.

The angle t between the magnetic pole surface a and the peripheral side face c is 95°. The diameter of the surface a is 18.7 mm, that of the surface b is 19.2 mm, the plate thickness is 3.2 mm, the diameter of the through-hole la is 6.2 mm, and the weight is 2.8 g.

Measurements of leakage flux at P-1, P-2, P-3, P-4 and P-5 of the magnet 1 of the Embodiment 5 alone, of the magnet 1 attached with the ferromagnetic member 2 and of the magnet 1 attached with both the attraction and attracted means A and B respectively are shown in Table 6.

The attraction force of the fastener means according to the Embodiment 5 was measured under the condition as shown in FIG. 32. As shown in Table 5, the average attraction force was 2.48 kg.

Embodiment 6

The attracted means B of the fastener means according to the Embodiment 6 shown in FIGS. 33 through 35 is not provided with the ferromagnetic projection 3*b*; instead, the ferromagnetic projection 2*b* projecting within the through-hole 1*a* is directly contacted with the ferromagnetic plate 3*a* of the attracted means B.

The angle t between the magnetic pole surface a and the peripheral side face c is 130°. The diameter of the surface a is 16 mm, that of the surface b is 21 mm, the plate thickness is 3.2 mm, the diameter of the through-hole 1*a* is 6.2 mm, and the weight is 2.8 g.

Measurements of leakage flux at P-1, P-2, P-3, P-4 and P-5 of the magnet 1 of Embodiment 6 alone, of the magnet 1 attached with the ferromagnetic member 2 and of the magnet 1 attached with both the attraction and attracted means A and B respectively are shown in Table 6.

The attraction force of the fastener means according to Embodiment 6 was measured under the condition as shown in FIG. 35. As shown in Table 5, the average attraction force was 2.52 kg.

TABLE 5

| | Attraction Force (kg) | | |
|---|---|---|---|
| Measurement | Comparative 3 Embodiment | Embodiment 5 | Embodiment 6 |
| I | 2.20 | 2.50 | 2.55 |
| II | 2.30 | 2.45 | 2.50 |
| III | 2.15 | 2.50 | 2.50 |
| IV | 2.30 | 2.40 | 2.55 |
| V | 2.30 | 2.55 | 2.50 |
| Average | 2.25 | 2.48 | 2.52 |

TABLE 6

| | Intensity of Magnetic Flux (Gauss) | | |
|---|---|---|---|
| Measurement point | Comparative 2 Embodiment | Embodiment 3 | Embodiment 4 |
| P-1 | 556 | 566 | 581 |
| P-2 | 308 | 295 | 281 |
| P-3 | 653 | 667 | 684 |
| P-4 | 272 | 265 | 242 |
| P-5 | 120 | 112 | 100 |

The permanent magnets 1 used in the Comparative Embodiment 3 and the Embodiments 5 and 6 all weigh 2.8 g, and are magnetized under the same conditions.

It is evident that the attraction force of the means of the Embodiment 5 shows an increase by 10.2% and that of the Embodiment 6 an increase by 12.0% as compared with the Comparative Embodiment 3.

The values of leakage flux on the magnetic pole surface a of the Embodiments 5 and 6 at P-1 and P-3 respectively are greater than those of the Comparative Embodiment 3, indicating that an excellent magnetic field suitable for attracting the means B is formed.

The values of leakage flux on the peripheral side face c of the magnet 1 at P-2, P-4 and P-5 in the Embodiments 5 and 6 respectively are smaller than those of the Comparative Embodiment 3, indicating that a magnetic field is suitably formed in the Embodiments to avoid destruction of information magnetically recorded on a magnetic ticket and the like which might otherwise be caused by the leakage flux from the peripheral side face c.

The peripheral side face c of the attraction means A as shown in FIG. 36 is not a simple slope connecting the magnetic pole surfaces a and b at a gradient; rather, the side face c rises at a right angle from the surface b and is tapered at an upper portion. The angle t between the surface a and the side face c is therefore the angle at this bend leading to the surface a.

The peripheral side face c of the attraction means A as shown in FIG. 37 is curved toward the surface a. The angle t between the surface a and the side face c is the angle between the surface a and the line segment connecting the start and the end of the curve.

In FIG. 38, the ferromagnetic projection 2*b* of the ferromagnetic member 2 is pressed into the through-hole 1*a*of the magnet 1 to assemble the magnet 1 and the ferromagnetic member 2 of the attraction means A.

In FIG. 39, the peripheral side of the magnet 1 is covered with a non-magnetic casing 11 to protect and assemble the same with the ferromagnetic member 2.

In FIG. 40, the non-magnetic casing 11 is a rectangle box with an opening on the bottom and a hole connecting to the hole 1*a* on the top, and has spaces 12 inside the casing 11. This construction prevents destruction of information magnetically recorded on a magnetic medium such as the bank cashing card or the credit card caused by leakage flux of the magnet 1 housed inside the casing together with the ferromagnetic member 2.

As mentioned above, because the angle t formed between the magnetic pole surface a of the magnet 1 constituting the attraction means A and the peripheral side face c extending between the magnetic poles is 95° or greater, the space between the magnetic poles including the peripheral side face c has a greater magnetic reluctance, and the magnetic flux of the permanent magnet 1 will form a magnetic circuit mainly comprising the ferromagnetic means 2 and 3 that are abutted against and attracted to each other via the through-hole 1*a* of the permanent magnet 1.

According to the present invention, as the angle t between the magnetic pole surface a and the peripheral side face c of the permanent magnet 1 constituting the attraction means A is larger than 95° , magnetic flux leaking outside from the peripheral side face c can be minimized, and the magnetic flux of the permanent magnet 1 can be concentrated on the contact point between the ferromagnetic member 3 of the attracted means B and the ferromagnetic member 2 of the attraction means A to secure high attraction force.

Because of lower leakage flux on the peripheral side face c, destruction of information magnetically recorded on a magnetic medium such as the bank cashing card and the like can be prevented.

What we claim is:

1. A magnetic fastener comprising:

a permanent magnet having a pair of magnetic pole surfaces and a peripheral side face extending between said magnetic pole surface, said magnet having a through-hole extending between said magnetic poles surfaces;

a first ferromagnetic member attached to one of said magnetic pole surfaces; and a second ferromagnetic member which is magnetically attachable to other of said magnetic pole surfaces and said first ferromagnetic member via said through-hole, wherein an angled formed by said other magnetic pole surface where said second ferromagnetic means is attached and said peripheral side face is greater than or equal to 95° to minimize the leakage flux through said peripheral side face to prevent interference with data stored on magnetic medium.

2. A magnetic fastener according to claim 1, wherein said first ferromagnetic member comprises a first ferromagnetic plate and a first ferromagnetic projection, and wherein said second ferromagnetic member comprises a second ferromagnetic plate and a second ferromagnetic projection, said first projection extending into said through-hole from the side of said one magnetic pole surface, and said second projection capable of extending into said through-hole from the side of said other magnetic pole surface and contacting said first ferromagnetic projection.

3. A magnetic fastener according to claim 2, wherein an edge formed by said peripheral side face and said other magnetic pole surface is rounded.

4. A magnetic fastener according to claim 2, further comprising a non-ferromagnetic casing to cover at least said peripheral side face.

5. A magnetic fastener according to claim 4, wherein said casing covers said side face, said other magnetic pole surface and a portion of said through-hole on the side of said other magnetic pole surface.

6. A magnetic fastener according to claim 5, wherein an angled formed by said casing which covers said peripheral side face and said other magnetic surface is substantially identical to said angle formed by said peripheral side face and said other magnetic surface.

7. A magnetic fastener according to claim 6, wherein an angled formed by said casing which covers said peripheral side face and said other magnetic surface is smaller than said angle formed by said peripheral side face and said other magnetic surface, whereby space is formed between said casing and said side peripheral face.

8. A magnetic fastener according to claim 7, wherein an angled formed by said casing which covers said peripheral side face and said other magnetic surface is about 90°.

9. A magnetic fastener according to claim 1, wherein said first ferromagnetic member comprises a first ferromagnetic plate, and wherein said second ferromagnetic member comprises a second ferromagnetic plate and a ferromagnetic projection, said projection capable of extending completely into said through-hole from the side of said other magnetic pole surface and being flush with said one magnetic pole surface upon said second ferromagnetic plate contacting said other magnetic pole surface and contacting said first ferromagnetic plate.

10. A magnetic fastener according to claim 1, wherein said first ferromagnetic member comprises a first ferromagnetic plate and a ferromagnetic projection, and wherein said second ferromagnetic member comprises a second ferromagnetic plate, said projection extending completely through said throughhole from the side of said one magnetic pole surface and being flush with said other magnetic pole surface so that said projection contacts said second ferromagnetic plate upon contact with said other magnetic pole surface.

11. A magnetic fastener according to claim 1, wherein an edge formed by said peripheral side face and said other magnetic pole surface is rounded.

12. A magnetic fastener according to claim 1, further comprising a non-ferromagnetic casing to cover at least said peripheral side face.

13. A magnetic fastener according to claim 12, wherein said casing covers said side face, said other magnetic pole surface and a portion of said through-hole on the side of said other magnetic pole surface.

14. A magnetic fastener according to claim 13, wherein an angled formed by said casing which covers said peripheral side face and said other magnetic surface is substantially identical to said angle formed by said peripheral side face and said other magnetic surface.

15. A magnetic fastener according to claim 13, wherein an angled formed by said casing which covers said peripheral side face and said other magnetic surface is smaller than said angle formed by said peripheral side face and said other magnetic surface, whereby space is formed between said casing and said side peripheral face.

16. A magnetic fastener according to claim 15, wherein an angled formed by said casing which covers said peripheral side face and said other magnetic surface is about 90°.

* * * * *